United States Patent [19]

Hanyu et al.

[11] 4,267,786

[45] May 19, 1981

[54] LOCK STITCHING AND OVERLOCK STITCHING SEWING MACHINE

[75] Inventors: Susumu Hanyu; Noboru Kasuga, both of Hachioji; Kazumasa Hara, Tama; Koichi Watanabe, Fussa, all of Japan

[73] Assignee: Janome Sewing Machine Co. Ltd., Tokyo, Japan

[21] Appl. No.: 860,589

[22] Filed: Dec. 14, 1977

[30] Foreign Application Priority Data

Dec. 17, 1976 [JP] Japan ..... 51-150749

[51] Int. Cl.[3] ..... D05B 1/14

[52] U.S. Cl. ..... 112/168; 112/163

[58] Field of Search ..... 112/2, 172, 168, 162, 112/7, 9, 28, 22, 155, 163, 34–37, 164, 165, 166

[56] References Cited

U.S. PATENT DOCUMENTS

| | | | |
|---|---|---|---|
| 877,508 | 1/1908 | Klemm | 112/163 X |
| 1,100,913 | 6/1914 | Ringe | 112/168 X |
| 1,692,094 | 11/1928 | Sawers | 112/168 X |
| 2,064,973 | 12/1936 | Gallens | 112/168 |
| 2,973,730 | 3/1961 | Schweda et al. | 112/163 |
| 3,116,706 | 1/1964 | Sigoda | 112/162 |
| 3,342,150 | 9/1967 | Tnetow et al. | 112/163 X |
| 3,429,275 | 2/1969 | Gorin et al. | 112/168 |

FOREIGN PATENT DOCUMENTS

| | | | |
|---|---|---|---|
| 160948 | 4/1921 | United Kingdom | 112/168 |
| 1267361 | 3/1972 | United Kingdom | 112/168 |
| 348659 | 9/1972 | U.S.S.R. | 112/163 |

*Primary Examiner*—Werner H. Schroeder
*Assistant Examiner*—Andrew M. Falik
*Attorney, Agent, or Firm*—Michael J. Striker

[57] ABSTRACT

A sewing machine having lock stitching device incorporated in a frame and driven by a primary driving member comprising a detachable overlock stitching device having its own needle bar driving mechanism spaced apart from the stitch forming part of the lock stitching device and driven by the same primary driving means. Preferably, a switching mechanism provides for the actuation of one stitching device while the other is at rest.

31 Claims, 51 Drawing Figures

FIG_7
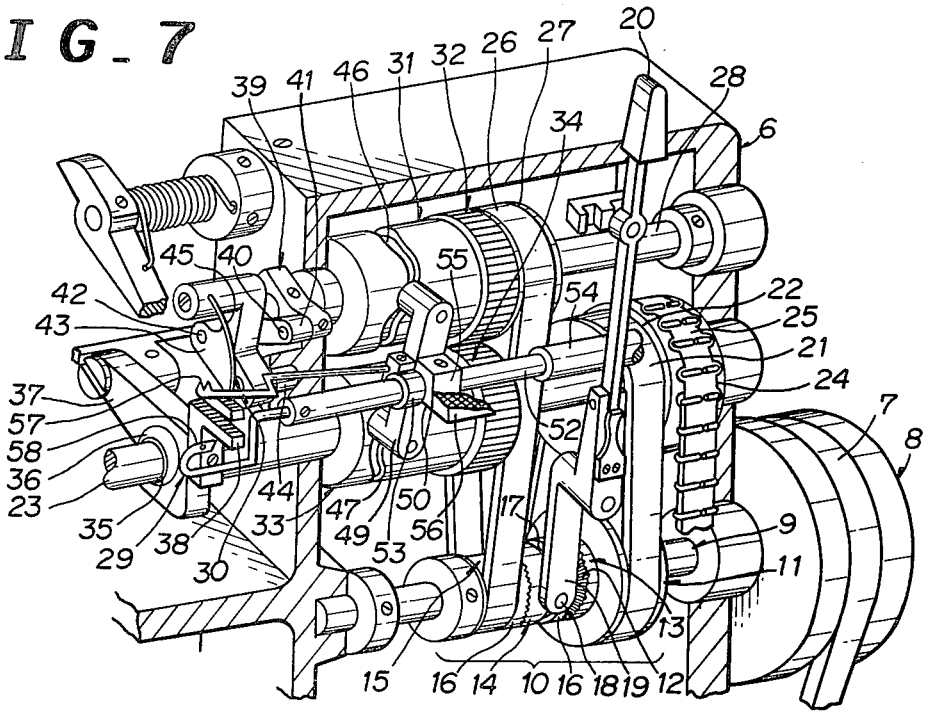
FIG_8
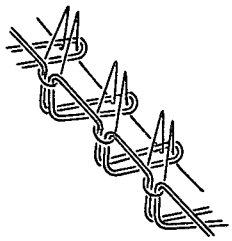
FIG_9
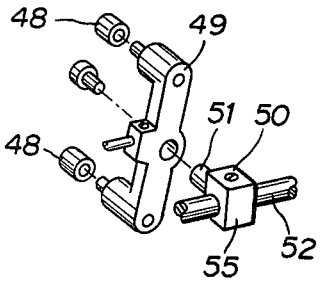
FIG_10a
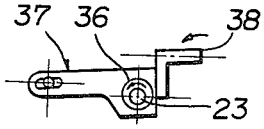
FIG_10b
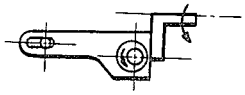
FIG_10c
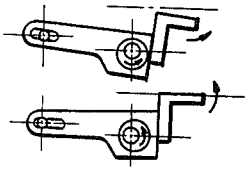
FIG_10d FIG_38
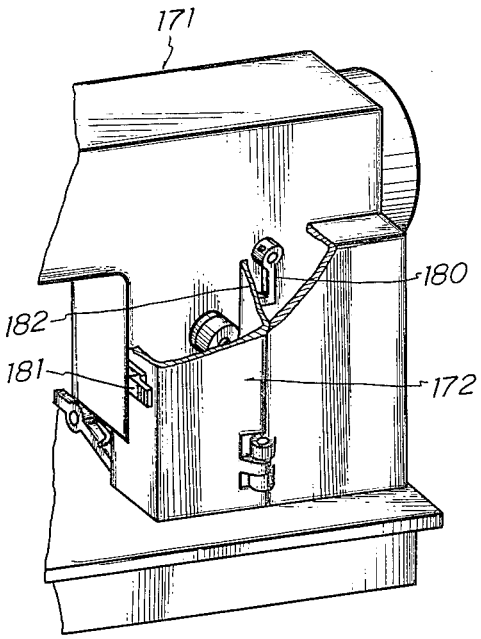
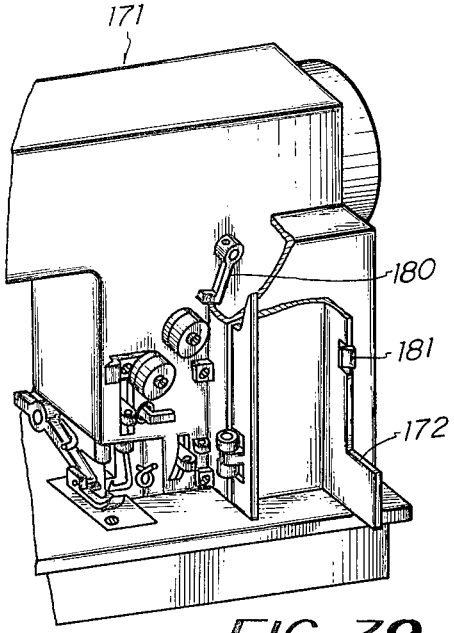
FIG_39
FIG_40
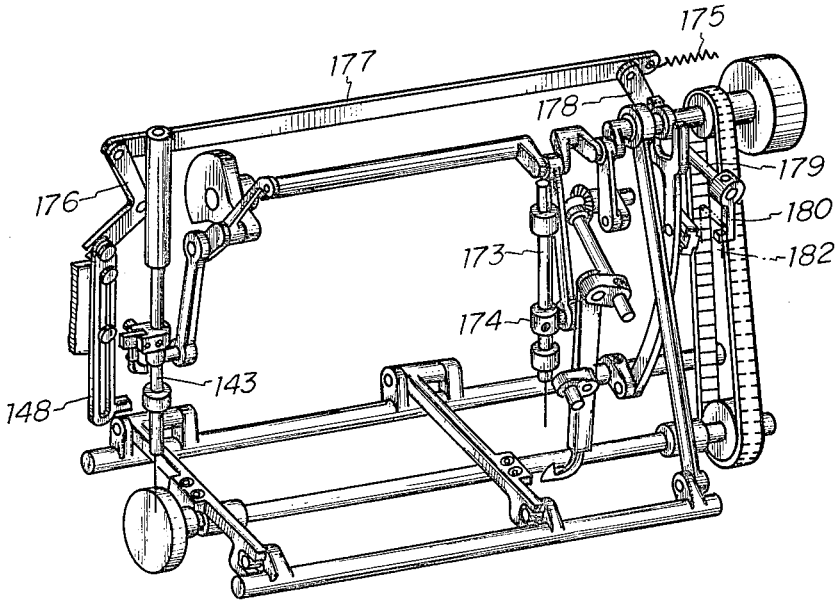

LOCK STITCHING AND OVERLOCK STITCHING SEWING MACHINE

BACKGROUND OF THE INVENTION

This invention relates generally to sewing machines, and more specifically it relates to a home sewing machine selectively operable for making lock stitches and overlock stitches.

In the mass production of sewn clothes, the lock stitches and the overlock stitches are most used. The former is for stitching edges of the cloth, and the latter is for darning and in addition for ordinary stitching when the clotch is very elastic such as knitted material.

In general home sewing activity, however, the lock stitches are most frequently used and not the overlock stitches. This fact does not mean that the overlock stitching is not desired in domestic sewing but it merely means that due to the different formations of these two kinds of stitches an additional cost, maintenance and storage made the machine for overlock stitching impractical.

Consequently, the zigzag stitching or so-called three-folded edge stitching has been substituted for the edge darning. However, the sewing technique has recently become diversified due to prevailing knitted materials, or because fashion has been taken into account, and the edge darning utilizing the lock stitching has not coped with the requirements. Especially, in very elastic materials such as jersey it is necessary to use stitches capable of matching the elasticity of the material. Also in this regard, the overlock stitching is desired.

SUMMARY OF THE INVENTION

The present invention has been devised to facilitate the overlock stitching in the home sewing work and to satisfy the requirements in this field.

A primary object of this invention is to enable an easy overlock stitching operation in a device having a simplified structure.

Another object of the invention is to broaden the utilization of the lock stitching sewing machine by detachably attaching thereto an overlock stitching device.

A further object of the invention is to drive the lock stitching device and the overlock stitching device either by means of respective driving members or by means of the same driving member.

Many other features and actual embodiments according to the invention will be apparent from the following explanation with reference to the accompanying drawings.

BRIEF DESCRIPTION OF THE DRAWINGS

FIG. 7 is a perspective view, partly in section, of the stitching part of the first embodiment of the overlock stitching device according to the invention;

FIG. 8 shows stitching formation of the device of FIG. 7;

FIG. 9 is a perspective exploded view of one part of the driving mechanism of a looper;

FIG. 10 shows movements of a feeding mechanism of the overlock stitching device;

FIG. 38 is a cutaway perspective view showing the unused condition of an overlock stitching device of the fifth embodiment of the device according to the invention;

FIG. 39 is a cutaway perspective view of the sewing machine of FIG. 38, showing a ready-to-use condition of the overlock stitching device;

FIG. 40 is a perspective view of the both stitching devices;

DESCRIPTION OF THE PREFERRED EMBODIMENTS

Figure 1:
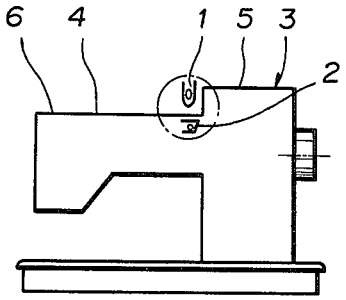
FIG. 1 is a schematic front view showing a stitching part of the first embodiment of the overlock stitching device mounted on a stepped flat portion formed on an upper part of a lock stitching sewing machine.

Two stitching devices, namely the lock stitching device and the overlock stitching device are incorporated within a single sewing machine frame and driven by a common driving member. These devices have, respectively, their own needles, feeding teeth, needle plates and thread taking levers. The two types of stitches are formed respectively in different parts of the sewing machine. Since a common machine frame is used for the both stitchings, the structure of this invention is more economical than that using two separate sewing machines which are specialized for the lock stitching and the overlock stitching respectively, and it is also more convenient for use and storage.

In FIGS. 1–6 the overlock stitching device is shown with an overlock stitching needle 1 and a looper 2 incorporated in different positions in the lock stitching sewing machine. It is, therefore, easy for an operator to handle and operate the lock stitching device as it is.

A reference will be made to a first embodiment of this invention as shown in FIGS. 7 to 11 where the overlock stitching device is provided in a position shown in FIG. 1. In this embodiment, the stitching part of the overlock stitching device is provided in a stepped flat portion 4 formed on the upper part of the free arm 6 and of the stand 5 of the lock stitching sewing machine 3, and the sewing machine is driven via a pulley 8 by a belt 7. The pulley 8 is secured on a driving shaft 9 which is furnished with a pair of mechanical clutches 10. The clutch 10 is composed of a follower clutch 13 for the lock stitching, which has a gear 12 integrated with a belt wheel 11 for driving the lock stitching device and which is axially restrained with respect to the driving shaft 9 but free in rotation, a driving clutch 14 which is restrained in rotation by a key but slidable axially, and a follower clutch 15 for the overlock stitching, which is axially restrained with respect to the follower clutch 13 and the driving shaft 9 and which is of the same shape as the follower clutch 13. The driving clutch 14 is formed with gears 16 at its both edges, and is geared with any one of the follower clutches 13 or 15 by operation of a knob 20 via a guiding pin 18 and a guiding lever 19 engaging in a guiding groove 17 formed at a center of the clutch 14. Therefore, according to this embodiment, the sewing machine is used either for the lock stitching or the overlock stitching operation by adjusting the control knob 20, whereby one stitching device is actuated and the other device is at rest.

The lock stitching device of this embodiment is in principle the same as that of the normal lock stitching sewing machine, and the thread taking lever, the needle bar and others are driven by the belt 21 and the belt wheel 22, and a lower shaft 191 (shown in FIG. 44) is driven via sprocket 24 and a timing belt 25, and a loop taker and a feeding mechanism are driven via the lower shaft.

The overlock stitching device is driven via the belt 26 and the belt wheel 27 by means of the overlocking shaft 28 to form stitches with an upper and a lower thread. The overlocking shaft 28 is fixed with an upper gear 32 integrated with an upper cam 31 for driving loopers 29, 30, and the upper gear 32 is engaged with a lower gear 34 integrated with a lower cam 33 for driving the loopers 29, 30. The lower gear 34 is secured on a hollow shaft 35 which is held at its hollow part by an upper shaft 23, and the hollow shaft 35 drives an eccentric feeding cam 36 fixed on an end portion thereof to deliver horizontal and tilting movements to a feeding gear 38 via a feeding shaft 35 gives a forward movement to the feeding gear 38, it rotates in a direction opposite to rotation of the upper shaft 23 of the lock stitching device, that is, in a clockwise direction, viewing from the pulley 8. The overlocking shaft 28 is secured with a crank 39 at its end portion, and a needle holder 43 is turned around a pin 44 secured to the arm 6 via a pin 40, a crank rod 41 and a pin 42 to drive an overlocking needle 45. The upper cam 31 and the lower cam 33 drive an upper looper holder 49 via rollers 48 (shown in FIG. 9) engaging in grooves 46, 47. The holder 49 transmits movement required for forming stitches to the upper looper 30 which is secured to an end portion of the holder 49, and it engages a pin 51 of a lower looper rod clamp 50 to give linear reciprocating movement to a lower looper 29 via the lower looper rod clamp 50 and a lower looper rod 52. The lower looper rod 52 is supported by the arm 6 and is slidably held by bushes 53, 54 and is restrained in rotation by an edge 55 of the lower looper bar clamp 50. The upper looper 30 is formed with a V-shaped groove 57 at its end portion to catch the lower thread passed through a thread hole 58.

A process of forming stitches by the upper and lower loopers 30, 29 is shown in FIG. 11. When knob 20 is moved to the right in FIG. 7 to urge the driving clutch 14 to engage the overlocking stitching follower clutch 15 for driving the belt wheel 27, the driving shaft 9 is rotated in the clockwise direction in FIG. 7 and the upper gear 32 is rotated in the same direction by the belt 26, but the lower gear 34 is rotated in the counterclockwise direction. The overlock stitching needle 45 turns vertically thereby, and the upper looper supporter 49 is moved by rotation of the grooves 46, 47 of the upper and lower cams 31, 33 so that the lower looper 29 makes a linear reciprocating movement. The upper looper 30 reciprocates horizontally together with the lower looper 29 while the looper 30 is turning in accordance with the turning movement of the upper looper supporter 49. Therefore, the upper looper 30 carries out a resultant movement similar to a movement shown in FIG. 31, and feeds a thread loop of the lower looper 29 onto a left side of the needle 45. The eccentric feeding cam 36 rotates in the counterclockwise direction in FIG. 7, and gives an elliptical movement to the teeth 38 for a forward feeding.

A process of forming overlock stitches will be referred to in FIG. 11. At first in (a), the upper looper 30 above the left side of the needle 45 holds the thread loop of the lower looper 29, and the needle 45 falls as passing through the thread loop so that the thread loop of the needle 45 is passed through the thread loop of the lower looper 29, and the thread loop rises a little above a lower dead point and swells, and the lower looper 29 starts to move to the right. When coming to (b), the upper looper 30 moves to the right as holding the thread loop, and the lower looper 29 moves to the right into the thread loop of the needle 45. When reaching (c), the upper looper 30 is under a moving path of the lower looper 29 and starts to rise, and then the lower looper 29 finishes to cause the thread loop to pass through the thread loop of the needle 45. At (d), the upper looper 30 catches the thread loop of the lower looper 29 and rises, and the lower looper 29 starts to move to the left, and then the feeding teeth 38 feeds the cloth and the stitches move. At (e), the feeding is completed and the thread loop of the lower looper 29 passes through said thread loop, and the thread loop of the needle 45 gets out of the lower looper 29 and the upper looper 30 feeds the thread loop of the lower looper 29 above the left side of the thread 45 and continues to move to the left, and the needle 45 again passes through the thread loop and falls down. In (f), the thread loop of the needle 45 reaches the lower dead point, and the upper looper 30 and the lower looper 29 still continue to move to the left. Again returning back to the (a) condition to repeat the above movements, the overlocking stitches are formed. In the above process, the lock stitching device is completely stopped.

For carrying out the lock stitching, the knob 20 is moved to the left to urge the driving clutch 14 to engage the lock stitching follower clutch 13 so that the upper shaft 23 is rotated in the clockwise direction in FIG. 7 via the belt wheel 8, the belt 21 and the sprocket 24. In the above process, the overlocking stitching device is completely stopped.

In this embodiment, a cutting edge which is employed in conventional overlock stitching is not incorporated because the home sewing does not require so much efficiency. The operator has to cut out the cloth in advance, and it is enough to use an appropriate means for guiding the cloth, and for the safety it is desirable to furnish the machine without the cutting edge. A thread taking lever for forming stitches for the sake of clarity is omitted in the drawing.

In this embodiment, the lock stitching device and the overlock stitching device are operated each in the different place of the machine. When one device is at work, the other is at rest, and therefore the operator cannot be injured by the needle or looper of the resting device. Thus, one of the features of the invention is that the clutch mechanism drives only one stitching device and stops the other. For this reason the invention contributes substantially to the safety of operation.

Also, the device of this embodiments changes the diameters of the two pulleys between the follower clutches 13 and 15 to increase the reduction ratio of the overlock stitching device in comparison with the lock stitching, because the moving torque of the overlock stitching device is in general lesser than that of the lock stitching device and rotates at high speed. Thus, it is also one of the features of the invention that the driving reduction ratio of the overlock stitching device is larger than that of the lock stitching device, so that the overlock stitching device may provide the optimum rotating speed.

Further, with respect to the feeding mechanism, the feeding rate is not changed and the structure is fairly simplified. The feeding movement is given to the teeth 38 in the structure shown in FIG. 7 by means of the eccentric feeding cam 36 fixed on the hollow shaft 35 which is mounted on the upper shaft 35. To provide easy and exact feeding is also one of the features of this invention.

Figure 2:
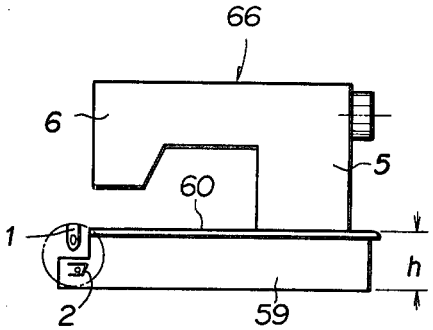
FIG. 2 is a schematic front view showing a stitching part of a second embodiment of the overlock stitching device mounted on a stepped flat portion formed on an edge of the bed of the lock stitching sewing machine.
Figure 3:
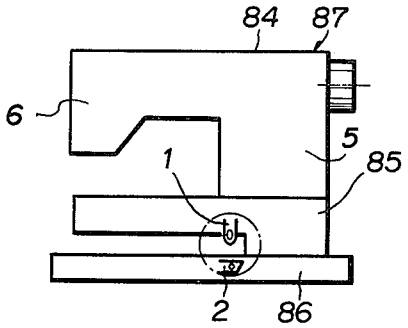
FIG. 3 is a schematic front view showing a stitching part of a third embodiment of the overlock stitching device mounted on an edge between a lower face and an upper face of the lock stitching sewing machine of a free arm type.

A second embodiment of this invention is illustrated in FIGS. 12 to 15 where the overlock stitching device is provided in a position shown in FIG. 2. In the embodiment, the stitching part 1 and 2 of the overlock stitching device is located on a recess formed on an edge of the bed 59 on the rear side of the lock stitching sewing machine 66. Height (h) of the bed 59 is higher than that of the ordinary sewing machine. The mechanism of the overlock stitching device is housed in the bed 59. This second embodiment is suitable for the so-called free arm type sewing machine having a horizontal loop taker, and the overlock stitching device is detachably housed under the auxiliary bed 62, and it is possible to use this sewing machine as the flat bed type sewing machine, as the lock stitching device is attached. The overlock stitching device may be easily attached to the flat bed type sewing machine.

The overlock stitching device is incorporated under the auxiliary bed 62 and is connected to the sewing machine by guiding pins 63, 64 and a stopper 65. A switching lever 69 is positioned at the left in FIG. 12, and an upper cover 67 of the auxiliary bed 62 as well as a side cover 68 are closed, so that the sewing machine may be used as a lock stitching sewing machine of the flat bed type. Conversely, when the upper cover 67 as well as the side cover 68 are opened and the switching lever 69 is positioned at the right, the sewing machine may be used as an overlock stitching sewing machine. If the auxiliary bed 62 is taken off, the sewing machine may be used as an ordinary lock stitching sewing machine of the free arm type. Also in this embodiment, the mechanical clutch may drive the stitching device as in the first embodiment.

Figure 13:
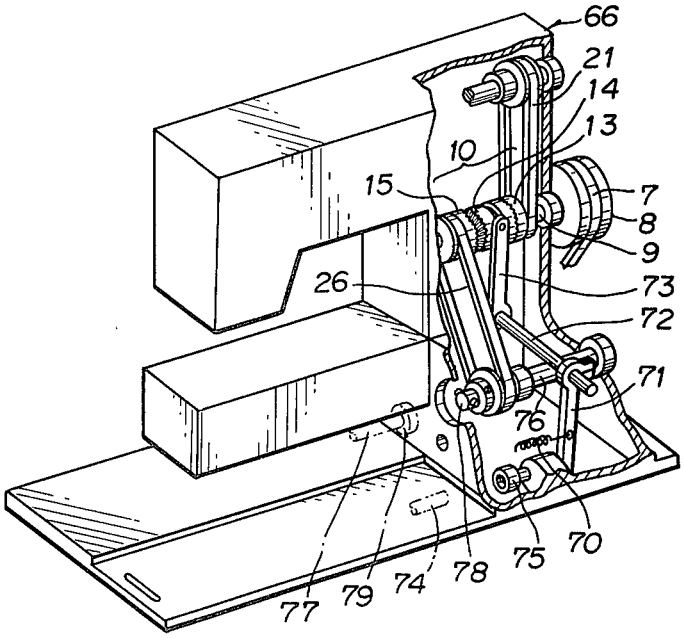
FIG. 13 is a perspective view, partially in section, of a driving mechanism of the device of FIG. 12.

In FIG. 13, the sewing machine 66 is driven via the pulley 7 by the belt 7, and the driving shaft 9 secured to the pulley 8 is provided with the mechanical clutch 10. In the clutch 10, the driving clutch 14 is geared with the lock stitching follower clutch 13 by a spring 70 via a connecting arm 71 and a guiding arm 73, and drives the lock stitching device by the belt 21. When the auxiliary bed 62 is attached to the machine frame and the switching lever 69 is positioned at the pulley side, a switching rod 74 cooperating with the switching lever 69 pushes out an intermediate rod 75 to push the connecting rod 71 against force of a spring 70, so that the driving clutch 14 is geared with the overlock stitching follower clutch 15 to interrupt gearing with the lock stitching device and driven an overlock driving shaft 76 via a belt 26. When the auxiliary bed 62 is attached, an overlock shaft 77 is connected with the overlock driving shaft 76 by means of couplings 78, 79, and the overlock stitching device is driven.

Figure 14:
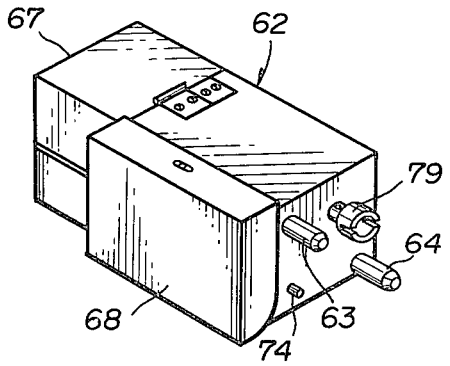
FIG. 14 is a perspective view of the overlock stitching device of this invention.
Figure 15:
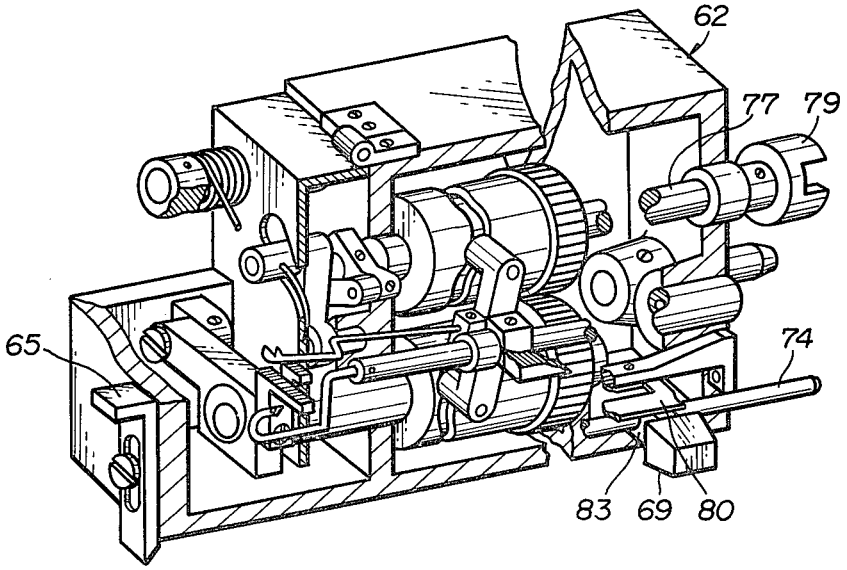
FIG. 15 is a perspective view showing inner mechanism of the overlock stitching device of FIG. 14.

An outer appearance of the auxiliary bed 62 where the overlock stitching device is built in, is shown in FIG. 14, and FIG. 15 shows an inner structure of the overlock stitching device. The essential parts are the same as in the first embodiment. The switching lever 69 is secured to a switching rod 74 and is always pressed down by a plate spring 80. This spring pressure causes a stem 83 to be fixed in notches 81 and 82.

The lock stitching device and the overlock stitching device are attachable and detachable, and in an operative condition each of the devices may be driven by the same driving source. This is one of the features of the invention. In the device of this second embodiment, partial mechanisms other than the needle bar may be used in common, for example, the feeding mechanism (see the third to fifth embodiments). Further, it is possible to install different driving sources for the lock stitching and the overlock stitching devices, which rotate in opposite directions. In the lock stitching sewing machine of the free arm type, the invention makes it possible to incorporate the overlock stitching device into the auxiliary bed 62 to form a compact unit.

Figure 18:
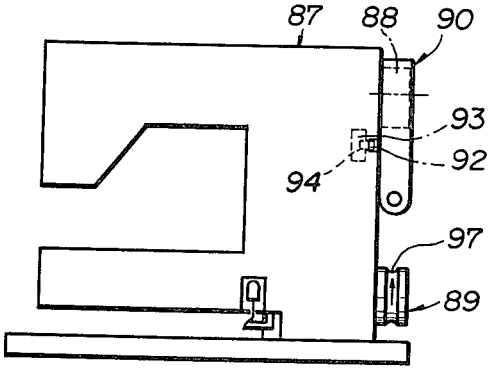
FIG. 18 is a front view showing a device for forming the overlock stitches in the sewing machine of FIG. 16.
Figure 19:
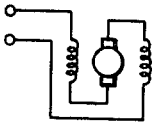
FIG. 19 is an electric circuit diagram of the motor for driving the machine of FIG. 18.
Figure 20:
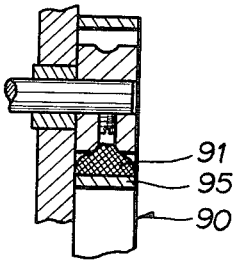
FIG. 20 is a vertical cross-section of a braking device of the machine of FIG. 18.

A third embodiment of this invention is shown in FIGS. 16–33. In this embodiment, the stitching part of the overlock stitching device 1 and 2 is located on an edge between an upper face of base 86 and a recess in bed 85 of the locking stitching sewing machine 87 (FIG. 3) of the free arm type, and the mechanism of the overlock stitching device is built in the arm 84, the bed 85 and the base 86. A sewing machine 87 in this embodiment is provided with a lock stitching flywheel 88 and an overlock stitching flywheel 89. A cover 90 shields non-used flywheel 88 or 89, and the cover 90 is fixed to one of the flywheels by means of a braking device 91 (FIG. 20), thereby to selectively drive the device to be used. The embodiment shown in FIG. 16 where a projection 92 formed on the cover 90 does not push a button 94 of a switch 93 provided on the sewing machine 87, makes use of a motor driving circuit as shown in FIG. 17, and the modification shown in FIG. 18 where the projection 92 pushes the button 94, uses a driving circuit as shown in FIG. 19 which drives the motor in the opposite direction than in the embodiment shown in FIG. 16. When the motor rotates in the normal direction, one of the stitching devices is driven by a pair of clutches in the same direction, and when the motor rotates in the opposite direction, the other stitching device is driven. In the cover 90 shown in FIG. 20, an interposed rib 95 is secured to a braking device 91 of an elastic material, and this braking device 91 elastically acts on a groove 96 or 98 to stop rotation of the flywheel 88 or 89 and also serves for positioning of the cover 90.

Figure 21:
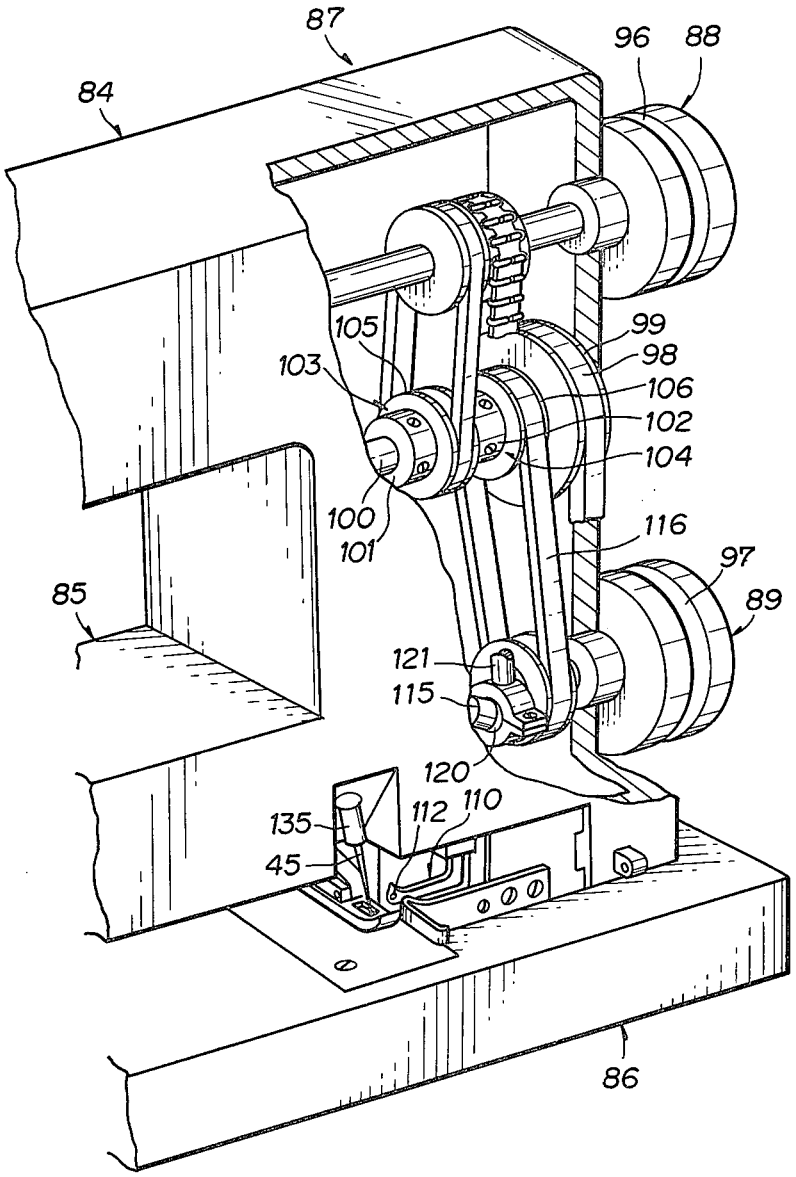
FIG. 21 is a perspective view of a driving mechanism of the overlock stitching device of FIG. 18.
Figure 22:
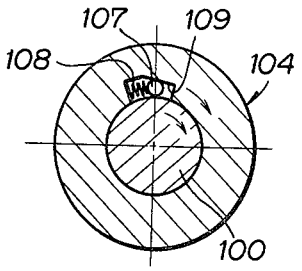
FIGS. 22–25 are vertical cross-sections showing operating conditions of a clutch rotating in one direction.
Figure 23:
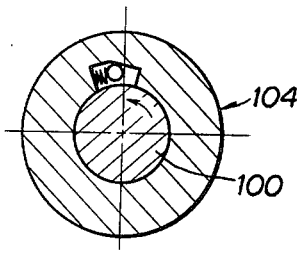
Figure 24:
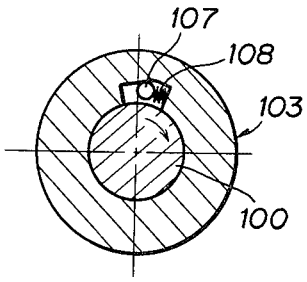
Figure 25:
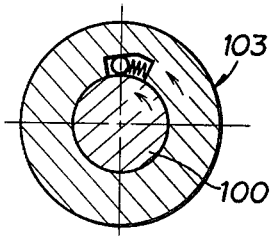

In FIG. 21, the sewing machine 87 is driven by a belt 98 via a pulley 99. A driving shaft 100 which is secured on the pulley 99 and held to the machine frame, is provided with lock stitching and overlock stitching clutch rings 103 and 104 rotating in one direction and axially restrained by rings 101, 102 and the pulley 99. The lock stitching clutch ring 103 is integrated with a lock stitching driving pulley 105, and the overlock stitching clutch ring 104 is integrated with an overlock stitching driving pulley 106. The clutch ring 104 comprises, as shown in FIGS. 22 and 23, a roller 107, a spring 108 and a groove 109. When the driving shaft 100 is rotated in the clockwise direction (reverse direction), the clutch ring 104 and the pulley 99 are rotated together with the driving shaft 100 (FIG. 22), and when the driving shaft 100 is rotated in the counterclockwise direction (normal direction), the clutch ring 104 is released from the driving shaft 100, and the driving shaft 100 rotates idly (FIG. 23). The lock stitching clutch ring 103 has, as shown in FIGS. 24 and 25, quite an opposite action with respect to the rotation of the driving shaft 100. Only when the driving shaft 100 is rotated in the counterclockwise direction (normal direction), the clutch ring 103 is rotated therewith.

In this embodiment, the rotating direction of the driving motor is switched by means of the cover 90, switch 93, flywheels 88, 89 and clutch rings 103, 104 to selectively drive the stitching device only. The stitching device is the same as in the first embodiment.

Figure 26:
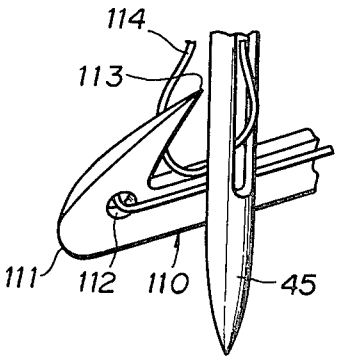
FIGs. 26 and 27 are perspective views showing the catching of a thread loop of the needle by a looper.
Figure 27:
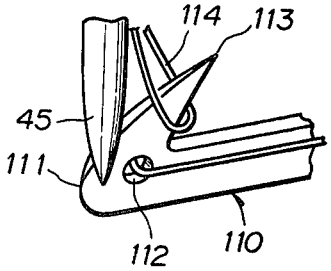
Figure 28:
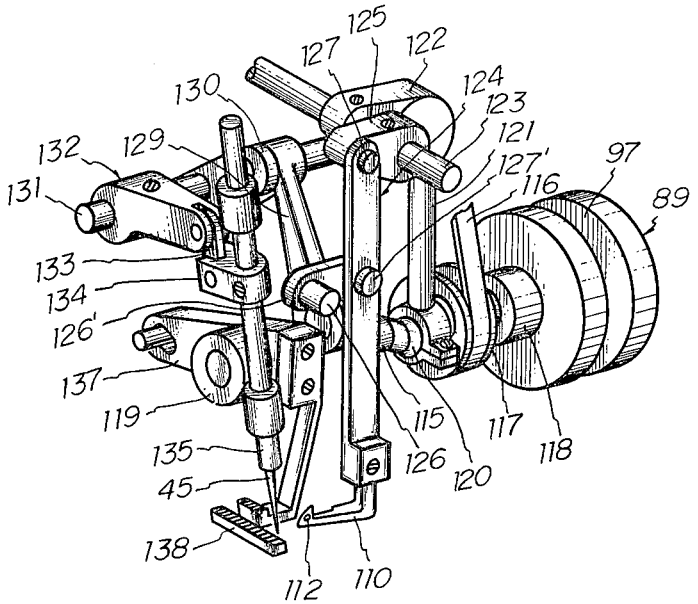
FIG. 28 is a perspective view of a stitching part of the overlock stitching device.
Figure 29:
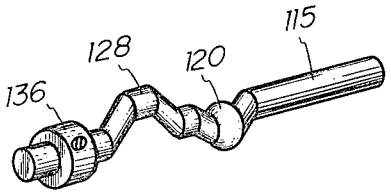
FIG. 29 is a perspective view of an overlocking shaft.
Figure 30A:
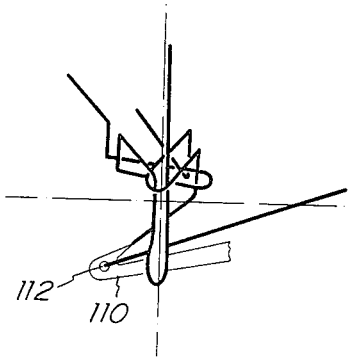
FIG. 30 shows in succession in the views (a)–(f) a process of forming the overlock stitches.
Figure 30B:
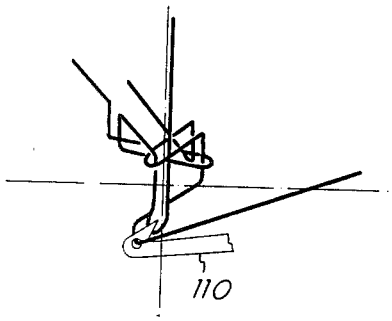
Figure 30C:
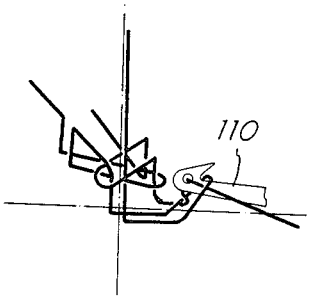
Figure 30D:
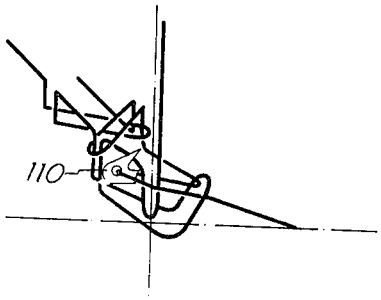
Figure 30E:
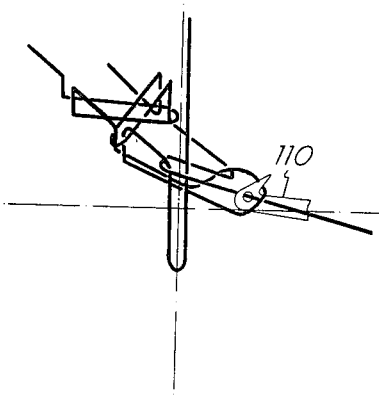
Figure 30F:
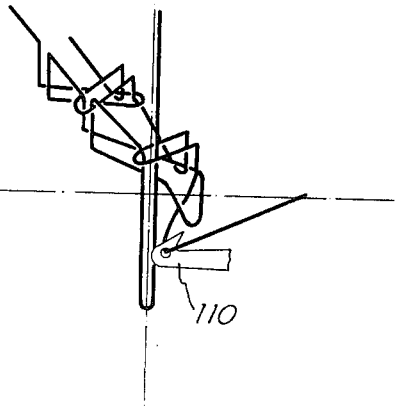
Figure 31:
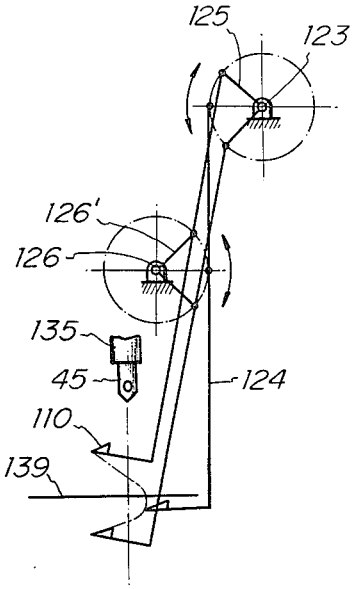
FIG. 31 is a schematical view showing movements of the looper of the overlock stitching device.

The overlocking device in this embodiment forms the stitches with the two threads as shown in FIG. 8, and a piece of looper 110 whose shape is shown in FIGS. 26 and 27 is employed. The looper 110 is formed with a hole 112 at its end 111 for the under thread and has a hook 113 for catching the thread 114 as shown in FIGS. 26 and 27. An overlocking shaft 115 shown in FIG. 28 is driven via the belt 116 and the pulley 117 by the overlocking clutch ring 104. The overlocking shaft 115 is shaped in accordance with FIG. 29 and is held by the bushes 118, 119. A ball crank 120 is connected to one end of a crank rod 121 to drive a looper shaft 123 via a looper rod 121 having a ball pin. The looper link 124 is connected to a looper shaft link 125 secured to a looper shaft 123 by a connecting pin 127, and to a guiding rod link 126' secured to a guiding rod 126 held to the machine frame by a connecting pin 127' to constitute a four-articulation link mechanism which is rotated around the looper shaft 123 and the guiding shaft 126. The looper 110 is fixedly screwed to a lower end of the looper link 124 to provide movements as shown in FIG. 31. The overlocking shaft 115 is formed with a crank portion 128 to give vertical movement to the needle bar 135 secured to the needle bar clamp 134 via the crank rod 129, crank arm 130, needle bar shaft 131, needle bar moving rod 132 and intermediate link 133. Further, the overlocking shaft 115 is mounted with an eccentric cam 136, and the eccentric cam 136 engages a feeding part 137 to give feeding movement to the feeding teeth 138 as shown in FIG. 10. The needle bar 135 has a slight inclination in the feeding direction with respect to horizontal movement of the looper 110, and this inclination is conventional in the art of forming the overlocking stitches.

Movements of the looper mechanism in the third embodiment may be explained by means of a simplified diagram shown in FIG. 31, since the looper shaft 123 and the guiding shaft 126 of the rotational centers are at the same side of the needle bar 135 with respect to the needle plate 139, a space under the needle plate 139 may be small. Thereby, it is possible to provide a holding and moving part of the cloth to be sewn on a thin base 86 as seen in the sewing machine in this embodiment. In other words, it is one of the features of the invention to arrange the basic mechanism such as the driving portion of the looper mechanism be on the same side of the needle bar 135 as the needle plate 139.

Figure 32:
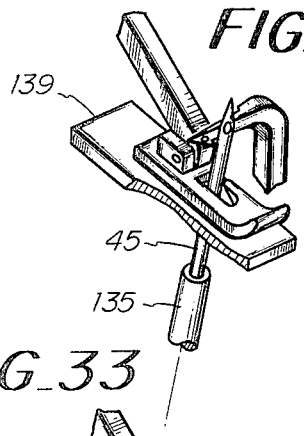
FIGS. 32 and 33 are perspective views showing an interrelationship between a needle and a looper when a needle bar is provided under the needle plate thereof.
Figure 33:
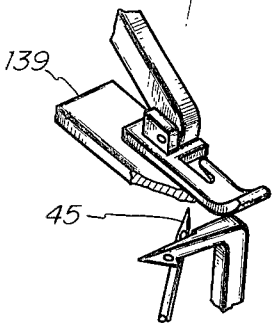
Figure 34:
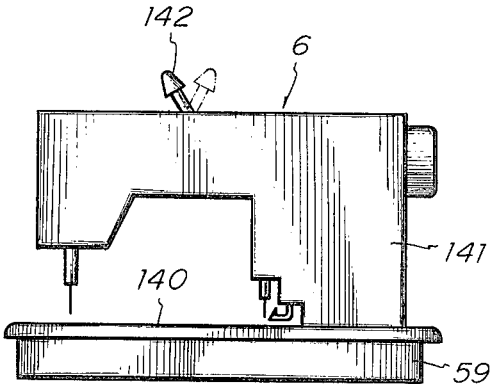
FIG. 34 is a front view of a sewing machine of a fourth embodiment of the device according to the invention.

An arrangement of the needle bar 135 under the needle plate 139 as shown in FIGS. 32 and 33 may be effectively applied to the first embodiment as shown in FIG. 1, and in this case the height of an upper surface of a stand 5 of the machine frame can be lowered. It is apparent that this feature is not limited to the looper mechanism of the third embodiment but applied to a looper mechanism of a later-mentioned embodiment.

The two rotating clutches rotating in one direction are used as mentioned above to change the rotating direction of the motor for driving one of the stitching devices, the flywheels 88, 89 are provided for the respective stitching devices and the cover 90 for the pulley of the non-used device switches the switch 93.

The stitches in the third embodiment are formed as shown in FIG. 30. For forming the overlocking stitches, the cover 90 is pushed up as shown in FIG. 18 to make the circuit shown in FIG. 19, and the machine motor is rotated reversely to drive the overlock stitching device by the clutch rotating in one direction, so that the overlocking shaft 115 is rotated in the counterclockwise direction shown in FIG. 28 to vertically move the needle bar 135 and at the same time the looper 110 moves as shown in FIG. 31 and the feeding part 137 carries out the feeding movement. FIG. 30-(*a*) shows that the needle 45 falls and rises a little to form a thread loop, and the looper 110 is positioned at the lower left edge, and at (b) the looper 110 moves to the right and catches the thread loop. Coming to (c) the looper 110 rises at the right of the needle 45 and feeds the caught thread loop under the cloth, and then the feeding teeth 138 feed the cloth. In (d) the looper 110 rises above the cloth and moves to the left, and releases the thread loop of the needle 45 and forms a new thread loop of the looper 110 through which the needle 45 passes, and a thread loop formed by the needle 45 is passed through the thread loop of the looper 110. In (e), the looper 110 moves to the right of the needle 45 and passes through the thread loop which has been left in (d), and falls down. At (f), the needle 45 reaches the lower dead point and the loop 110 moves to the lower left oblique direction. Thus, one stitch is formed. When the overlocking shaft 115 is further rotated, formation of a thread loop is returned to (a) condition for a subsequent stitch.

Figure 16:
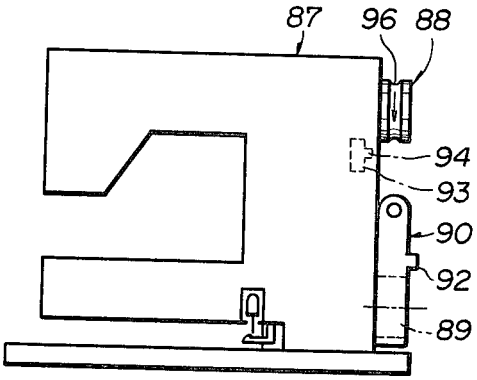
FIG. 16 is a schematic front view of the third embodiment of the device for forming the lock stitches.
Figure 17:
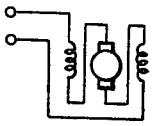
FIG. 17 is an electric circuit diagram of a motor for driving the machine of FIG. 16.

For forming the lock stitches, the cover 90 is pushed down as shown in FIG. 16 to make the electric circuit shown in FIG. 17, and the machine motor is rotated in the normal direction, so that the upper shaft 23 is rotated in the clockwise direction in FIG. 21 via the clutch rotating in one direction, thereby to enable to perform the lock stitching. In this case, the pulley 89 is controlled by the braking device 91, and the overlock stitching device is stopped.

Figure 4:
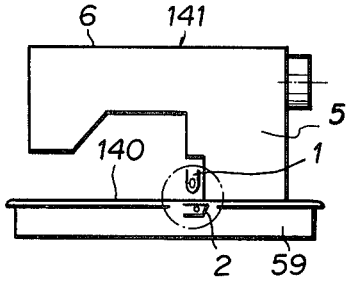
FIG. 4 is a schematic front view showing a stitching part of fourth and fifth embodiments of the overlock stitching device mounted on a connection between an arm and a bed of the lock stitching sewing machine.

A fourth embodiment of this invention is shown in FIGS. 34–37 where the overlock stitching device is provided in a position shown in FIG. 4. In this embodiment, the stitching part of the overlock stitching device is positioned in the rear side of a stand 5 connecting the arm 6 and a bed 59 of the lock stitching sewing machine 141 (FIG. 4), and the mechanism of the overlock stitching device is built in the stand and the bed 59. In the sewing machine 141 of this embodiment, a switching lever 142 exposed on the arm 6 is operated, thereby to drive the stitching device to be used and to stop the needle bar of the other stitching device nearly at the upper dead point. Therefore, the mechanisms of the both devices are operated concurrently except for the needle bars, and since the thread taking levers of the lock and overlock stitching devices and the loopers are at operation, a danger of injury is more or less present. By furnishing safety covers or shields, the danger of injury of the operator may be eliminated.

Figure 36:
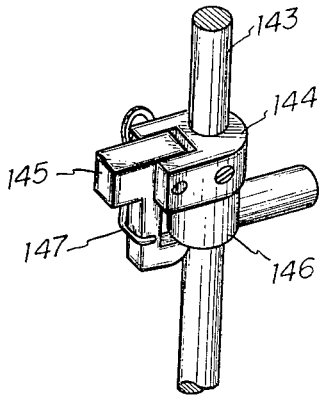
FIG. 36 is a perspective view of a connection between a lower needle bar clamp and the needle bar.
Figure 37:
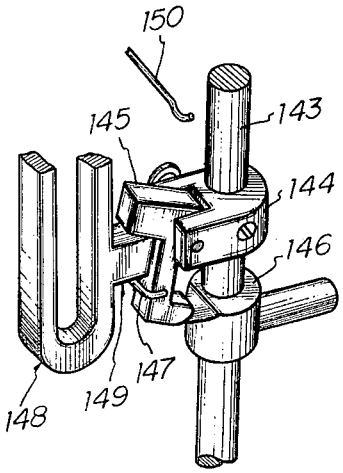
FIG. 37 is a perspective view of the connection of FIG. 36 when the both parts are separated.
Figure 41:
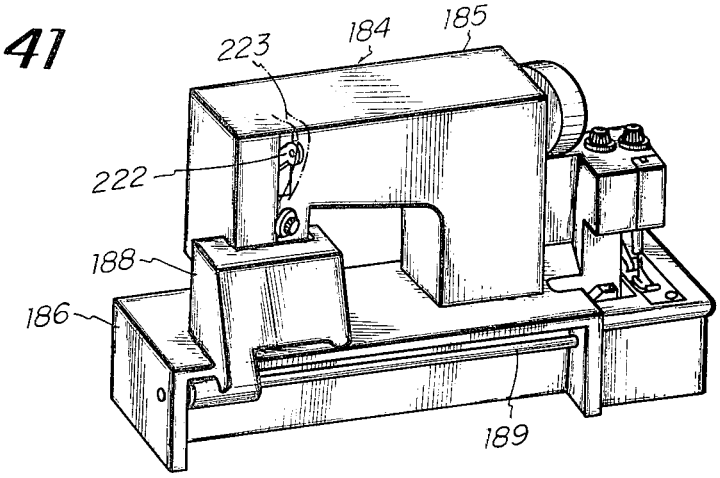
FIG. 41 is a perspective view showing an overlock stitching device of a seventh embodiment according to the invention in its ready-to-use condition.
Figure 42:
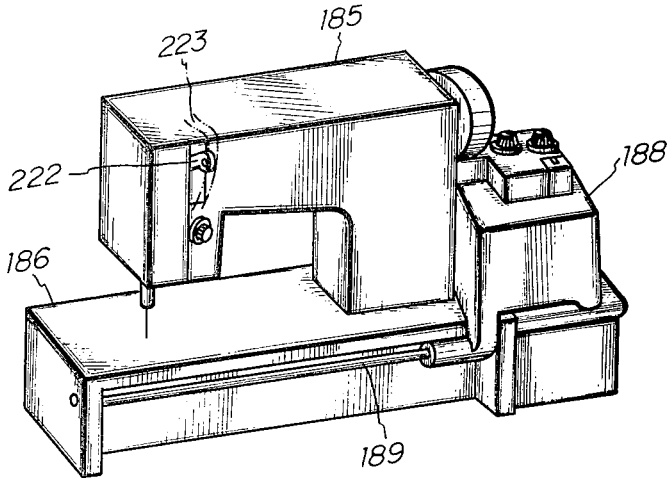
FIG. 42 is a perspective view showing a lock stitching device in its ready-to-use condition.

The lock stitching device is the same as that of the ordinary lock stitching sewing machine, but the driving mechanism of the needle bar 143 is different as shown in FIGS. 36 and 37, and the lower needle bar clamp 146 and the needle bar 143 are engageable in the axial direction of the needle bar 143 by means of a pawl 145 pivoted on an upper needle bar clamp 144 which is secured on the needle bar 143. The pawl 145 is always urged by a spring 147 as shown in FIG. 36 to connect the needle bar 143 of the lower needle bar clamp 146, but a switching plate 148 which is vertically movable is pushed up to rotate the pawl 145 in the clockwise direction against pressure of the spring 147 at a projection 149, thereby to release connection between the needle bar 143 and the lower needle bar clamp 146. After having released said connection by the switching plate 148 and when the plate 148 is made to fall, the needle bar 143 drops due to its own weight until the upper needle bar clamp 144 contacts to the lower needle bar 146 and the pawl 145 is caused to connect to the lower needle bar clamp 146, or when such connection is impossible because of little falling, the sewing machine 141 is driven to raise the needle bar 143 via the lower needle bar clamp 146 and to act on the upper needle bar clamp 144 nearly at the upper dead point of the needle bar 143 so that the pawl 145 is engaged with the lower needle bar clamp 146 by pressure of the spring 147 rotating the upper needle bar clamp 144 in the counterclockwise direction.

The overlock stitching device in this fourth embodiment is driven by an upper shaft 151 in common to the lock stitching device, and turns the upper looper shaft 155 via a crank rod 153 whose one end is connected to a first crank portion 152 provided on the upper shaft 151, an upper looper rod arm 154, an upper looper shaft 155, an upper gear 156, and a lower gear 157 for imparting movement to the looper 110 in the same structure as in the third embodiment. A second crank portion 159 provided on the upper shaft 151 is connected to a rod 160 for driving a needle bar 161 of the same structure as in the lock stitching device. The feeding mechanism is common to the lock device in the basic mechanism, and feeding is effected by a feeding part 163 for the overlocking of the same shape as the feeding part 162. The lock stitching needle bar 143 and the overlock stitching needle bar 161 form the same angle with the feeding direction (bed face), and the angle with the feeding direction may be a right angle. The overlocking stitches are formed in the same manner as in the third embodiment shown in FIG. 30.

Figure 35:
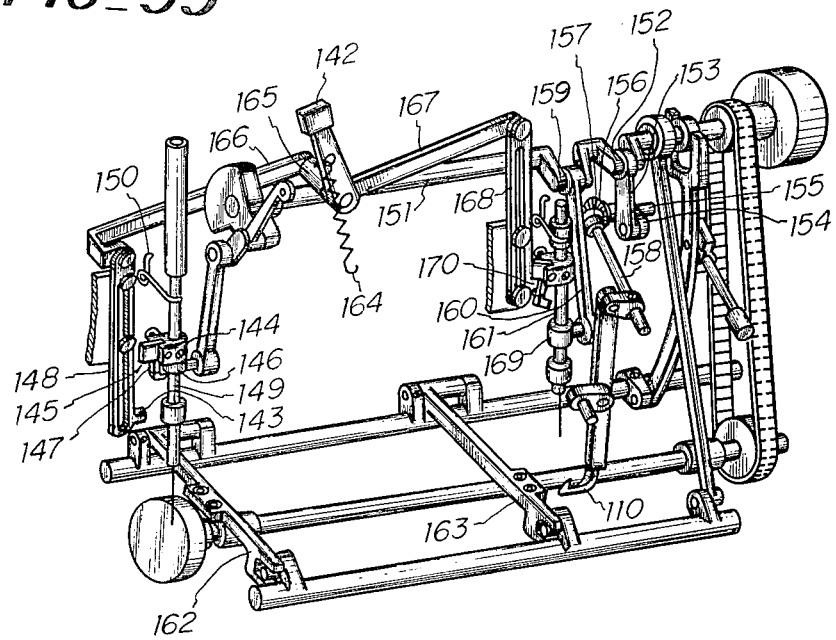
FIG. 35 is a perspective view of mechanisms of the lock stitching and the overlock stitching devices.

This fourth embodiment is different from the first to third embodiments, and the non-used stitching device stops only the movement of the needle bars 143 or 161 while the other parts of the mechanism are running. In FIG. 35, the switching lever 142 is supported for rotation around a switching lever shaft 165 and is urged to the front or to the back of the sewing machine by means of a spring 164, and its position can be selected at will. When the switching lever 142 is made to fall to the front of the sewing machine in FIG. 35 a connecting rod 166 lets the lock stitching switching plate 148 fully descend so that the needle bar 143 and the lower needle bar clamp 146 are connected to provide an operating condition of the needle bar 143. The connecting rod 167 fully pushes up the overlock stitching switching plate 168 to release connection between the needle bar 161 and the lower needle bar clamp 169 by means of a needle bar releasing mechanism (same as in the lock stitching device), and to stop the needle bar 161 above the upper dead point by means of the switching plate 168 and a projection 170.

Reversely, when the switching lever 142 is made to fall to the back of the sewing machine the overlock stitching needle bar 161 is driven and the lock stitching needle bar 143 is stopped. Thus, when one stitching device is operative, the other is inoperative.

A fifth embodiment is shown in FIGS. 38–40 where the overlock stitching device is provided also in the position shown in FIG. 4. In this embodiment the stitching part 1 of the overlock stitching device is located on a flat portion of a recess formed in the stand connecting the arm and the bed of the lock stitching sewing machine 171. A cover 172 is furnished for shielding exposed moving parts of the overlock stitching device. When the cover 172 is closed, both stitching devices are driven simultaneously, and when the cover 172 is opened, the needle bar 143 of the lock stitching device is stopped and only the overlock stitching device is driven.

This fifth embodiment is the same as the fourth embodiment as shown in FIG. 40 except that the needle bar 173 of the overlock stitching device is directly connected to the needle bar clamp 174, and the mechanism of the lock stitching switching plate is different. The exposed moving parts of the overlock stitching device can be shielded with the cover 172 to avoid danger caused by the non-used stitching device. That is, safety is maintained by stopping the needle bar (as seen in the fourth embodiment) when the lock stitching device is inoperative and when the overlock stitching device is inoperative the cover 172 shields the exposed moving parts. More specifically, the lock stitching switching plate 148 is always pushed up via a bell crank 176 and a rod 177 by a spring 175 for stopping the needle bar 143 as shown in the fourth embodiment. The rod 177 is connected to a switching arm 180 via a connecting arm 178 and a connecting shaft 179. When the cover 172 is closed firmly by a fastener 181, a wall 182 of the cover 172 pushes the switching arm 18 against pressure of a spring 175 and pushes down the switching plate 148 via the rod 177 and the bell crank 176 to provide a driving condition for the lock stitching needle bar 143. When the cover 172 is opened as shown in FIG. 39 and strength against the pressure of the spring 175 is cancelled, rod 177 is pulled to the back of the sewing machine by the spring 175 and the switching plate 148 rises to stop the lock stitching needle bar 143. Thus, when one stitching device is driven, the needle bar of the other stitching device is stopped, and when the other stitching device is driven, the exposed dangerous moving parts of the non-used device are shielded with a cover.

Figure 5:
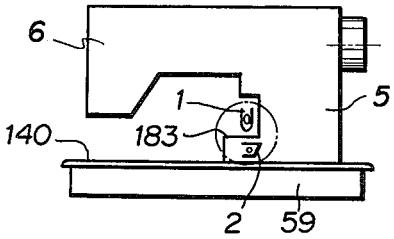
FIG. 5 is a schematic front view showing a stitching part of a sixth embodiment of the overlock stitching device mounted on a stepped flat portion formed on a connection between an arm and a bed of the lock stitching sewing machine.

In a sixth embodiment of this invention the overlock stitching device is arranged at the position shown in FIG. 5. In this embodiment, the stitching part of the overlock stitching device is located on a stepped flat portion of a recess formed on arm 6 and a bed of the lock stitching sewing machine. The element part of the overlock stitching device is housed under the arm 6 and the bed 59. This sixth embodiment is a modification of that shown in FIG. 4 (the fourth and fifth embodiments), and the mechanisms of the fourth and fifth embodiments may be applied as they are.

It is, of course, possible to modify the embodiments according to the invention to form flat parts on an upper face of the arm 84 and on an upper face of the base 86.

Figure 6:
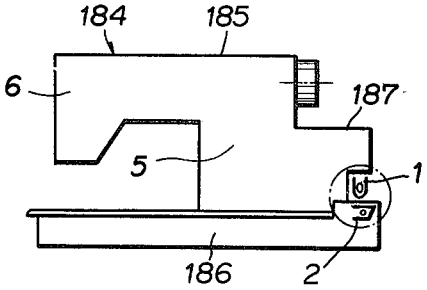
FIG. 6 is a schematic front view showing a stitching part of a seventh embodiment of the overlock stitching device mounted on a back edge portion of the lock stitching sewing machine.
Figure 11A:
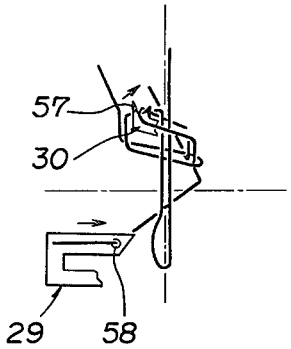
FIG. 11 shows in succession in the views (a)–(f) a process of forming the overlock stitches.
Figure 11B:
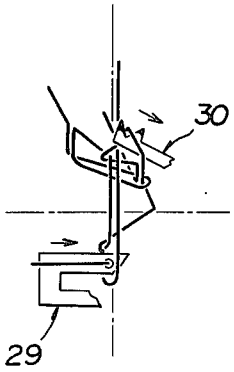
Figure 11C:
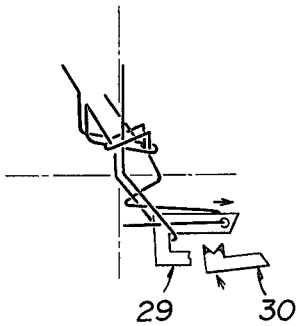
Figure 11D:
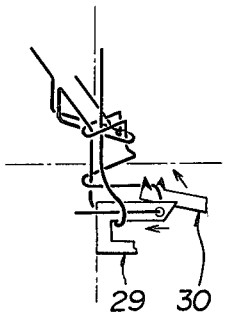
Figure 11E:
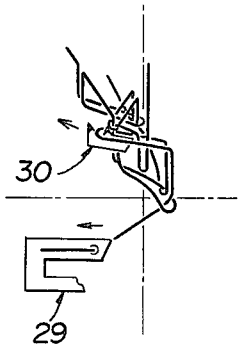
Figure 11F:
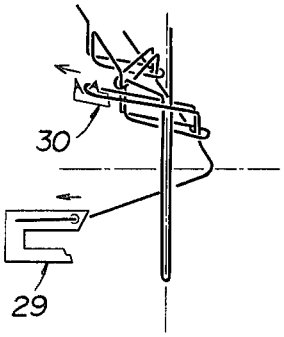
Figure 12:
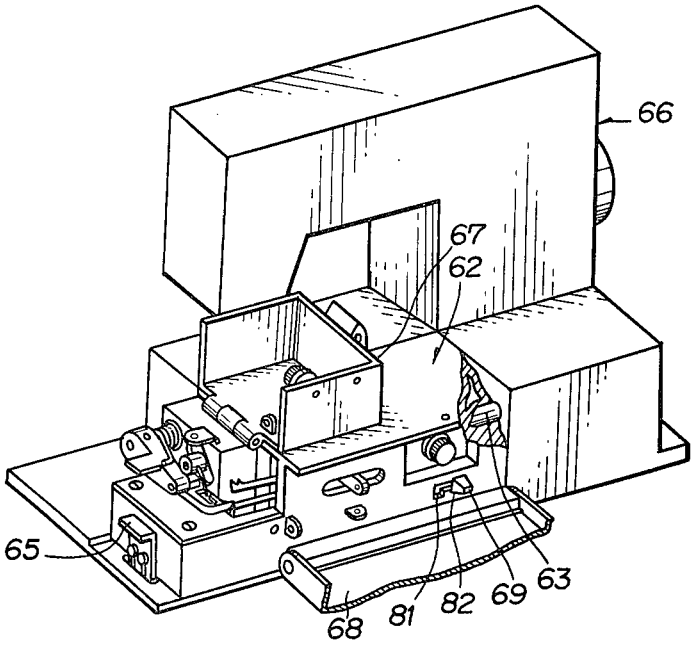
FIG. 12 is a perspective view of the second embodiment of the device according to the invention showing the overlock stitching device incorporated under an auxiliary bed of a free arm sewing machine.

In a seventh embodiment the overlock stitching device is installed at a position shown in FIG. 6. In this embodiment, the stitching part of the overlock stitching device is located on an enlarged and elongated portion of the back edge of the lock stitching sewing machine, and the arm 185 of the sewing machine 184 and the wall of the pulley side of the bed 186 are partially enlarged, and in this enlarged portion the mechanism of the overlock stitching device is incorporated. It is sufficient to reverse the right side and the left side of the ordinary overlock stitching sewing machine for this overlock stitching device. If the wall of the pulley side is enlarged a variation of the third and fifth embodiments will be provided. The cloth feeding direction of the overlock stitching is turned reversely to that of the lock stitching, that is, if the sewing machine is turned 180° when the lock stitching and the overlock stitching are switched, the ordinary overlock stitching mechanism may be incorporated as it is.

Figure 43:
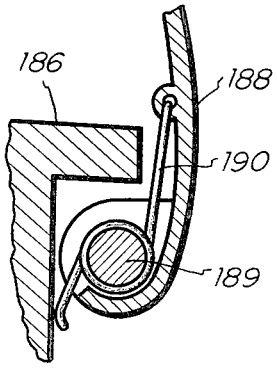
FIG. 43 is a vertical cross-section of a spring mechanism of a cover of the device of FIG. 42.

This seventh embodiment will be explained with reference to FIGS. 41–44. In the sewing machine 184, both the lock stitching device and the overlock stitching device are always driven, and the exposed dangerous moving parts of the non-used stitching device are shielded by a cover 188 to relevate the safety. The cover 188 as shown in FIG. 43 is held on a guiding rod 189 provided on the surface of the bed 186, and is always pressed to an arm 185 (in the counterclockwise direction). The displacement of the cover 188 from one device to the other device is effected by pulling the cover 188 against pressure of the spring 190 along the guiding rod 189.

Figure 44:
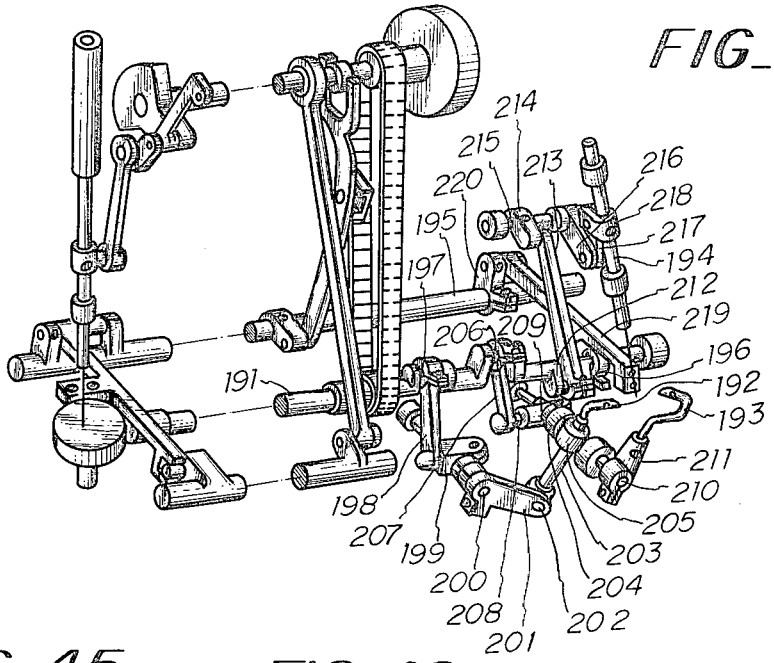
FIG. 44 is a perspective view of a mechanism of the both stitching devices.
Figure 45:
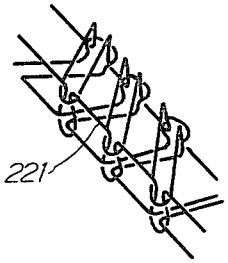
FIGS. 45 and 46 show steps of forming conventional overlock stitches.
Figure 46:
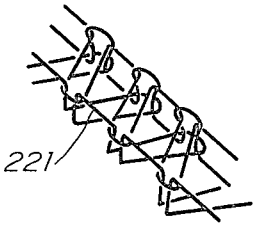

The inner mechanism of the sewing machine 184 relating to the seventh embodiment is seen in FIG. 44, and the ordinary one is sufficient for the lock stitching device. The overlock stitching device forms stitches with three theads as shown in FIGS. 45 and 46, and a common low shaft 191 of the lock stitching device is used to drive an upper looper 192, a lower looper 193, the needle bar 194 and the thread taking lever (not shown) for moving feeding teeth (not shown) by means of an eccentric cam 196 secured to the lower shaft 191 and a horizontal feeding shaft 195 of the lock stitching device. A ball crank rod 198 is connected at its one end to a first bell crank portion 197 of the lower shaft 191 and connected at its other end to an upper looper 199 having a ball pin. The upper looper arm 199 is fixed to an upper looper shaft 200, the upper looper shaft 200 is connected to one end of an upper looper actuating arm 201, a pin 202 fixed to one of the upper looper actuating arm 201 is connected to an upper rod 203, and the upper looper rod 203 imparts the resultant sliding and turning movement to the upper looper 192 via an upper looper guide 205 whose center shaft is pivoted in a bush 204 fixed to the machine frame. A second ball crank portion 206 of the lower shaft 191 is connected to one end of a ball crank rod 207, this ball crank rod 207 is connected at its other end to a ball crank pin 208 which is formed in a lower looper arm 209 as one part thereof; the lower looper arm 209 is secured to the lower looper shaft 210 and the lower looper shaft 210 is rotatably connected to the machine frame, the lower looper shaft 210 is secured at its one end with a lower looper actuating arm 211, and the lower looper actuating arm 211 is secured with a lower looper 193 to turn around the lower looper shaft 210. A crank portion 212 of the lower shaft 191 gives vertical movement to the needle rod 194 via a crank rod 213, needle bar shaft arm 214, needle shaft 215, needle bar actuating arm 216, intermediate link 217 and needle bar clamp 218. The horizontal movement of the feeding teeth is effected via a feeding arm 220 and a feeding portion 219 by a horizontal feeding shaft 195.

For the looper mechanism and the needle bar mechanism of the overlock stitching device in this seventh embodiment, the mechanism of the ordinary overlock stitching sewing machine is incorporated as it is in the reverse condition of right and left. The stitches shown in FIGS. 45 and 46 seem different, but actually only the tension effected by the three threads is changed. The stitches in FIG. 45 are formed in that the upper thread is made strong in tension, and those in FIG. 46 are formed in that the upper thread is made weak in tension, the thread taking lever 222 is shielded with a cover 223.

The overlocking stitches according to this invention will be discussed with reference to FIGS. 49 to 51. The overlocking stitches vary according to the use of one thread to four threads, and these stitches are another objective of the invention. These stitches may be provided by making minor changes on each of the embodiments as it will be explained below.

Figure 47:
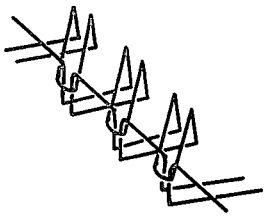
FIGS. 47 and 49–51 show steps of forming stitches by the device of this invention.
Figure 48:
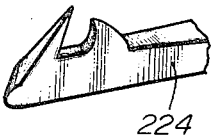
FIG. 48 is a perspective view of a deformed looper to be used in the third to fifth embodiments.

Stitches shown in FIG. 47 are formed with one thread by exchanging the looper 224 in the third and fifth embodiments with a looper 224 shown in FIG. 48.

Figure 49:
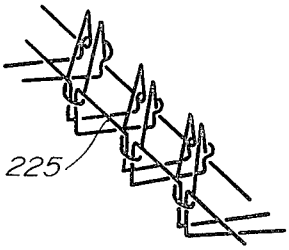

Stitches shown in FIG. 49 are formed with two threads by changing the thread tension of the stitches shown in FIG. 8 to make the upper thread 225 weak. It is often desirable to change the tension of the thread in accordance with different overlock stitching for effecting variances on the stitches. FIGS. 45 and 46 show examples thereof.

Figure 50:
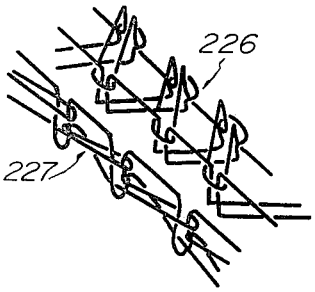

Stitches shown in FIG. 50 are called as interlock stitches, and double chain stitches 227 are formed concurrently besides the overlocking stitches 226, which may be easily put into practice by installing a double chain stitching device in addition to the embodiments of the invention. In this regard, the needle bar may be common with the overlocking stitching device.

Figure 51:
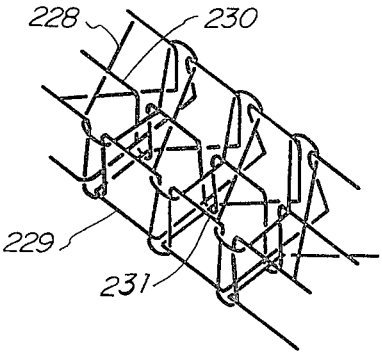

Stitches shown in FIG. 51 are formed with two needles and four threads of an upper looper thread 228 passing through an upper looper, a lower looper thread 229 passing through a lower looper, a right upper thread passing through a right needle, and a left upper thread passing through a left needle, for example, these stitches may be effected by providing the two needles in the sixth embodiment. There are many overlocking stitches by the two needles, but those may be formed by exchanging the looper without changing the others.

In each of the above-mentioned embodiments, the feeding direction of the cloth is the same as that of the ordinary lock stitching sewing machine, but the invention is not limited to them, and a direction to the upper shaft may be permitted, or it is possible to turn the sewing machine around the upper shaft to make the cloth feeding part horizontal, and all such modifications similar to the disclosed embodiments are apparently included in the present invention.

In summation, the lock stitches and the overlock stitches may be formed by one sewing machine, and the device according to the invention is very convenient. Especially the edge darning which has been conventionally performed by the zig-zag stitching, may be effected by the overlock stitching, and therefore the possible range of the home sewing is broadened and the quality of the sewn production is improved.

In the invention, the lock stitching and overlock stitching is selectively used. During operation of the one stitching device, the needle bar of the other stitching device is stopped to make noise low and prevent the operator's fingers or the cloth from being damaged. There are provided switching means which make it possible to rotate the machine motor in the normal and reverse directions and the two sets of the clutches rotating in one direction which selectively transmit rotation of the driving shaft rotated by the machine motor to the respective devices, and the first device is only driven without any complicated movement for selecting the stitches. The first device is selected by shielding the pulley with the cover, and the switch is operated by the cover to reverse the rotating direction of the machine motor.

Further, the moving torque of the lock stitching sewing machine for moving the mechanism is large while that of the overlock stitching sewing machine is small, and in order that the power is transmitted from the same driving source, both devices may be rotated at the same speed, since the reduction ratio for the overlock stitching device has been in advance made large. If the reduction ratio be equal, the overlock stitching device would rotate inconveniently at high speed.

Besides, since the looper driving portion of the overlock stitching device is provided at the same side as the needle bar with respect to the needle plate, the mechanical part under the needle plate (when the needle bar is provided under the needle plate, the mechanical part is above the needle plate) may be small, and the stitching part of the overlock stitching is positioned at disposal.

The upper shaft and the lower shaft of the lock stitching device are provided with the hollow shaft having the eccentric cam, and the full rotation in one direction of the eccentric cam gives the elliptical movement to the feeding portion to provide the feeding for the overlock stitching, and therefore it does not make it necessary to prepare another feeding mechanism for the overlock stitching mechanism. Thus, the structure is simplified for providing the excellent feeding in function.

In addition, the overlock stitching device according to the invention is made compact to be attachable to the lock stitching device, thereby to carry out the overlock stitching by attaching the overlock stitching device thereto if necessary, while using it as the lock stitching sewing machine ordinarily, paying attention to the safety measures.

Furthermore, the overlock stitching device is incorporated under the auxiliary bed of the free arm type sewing machine for operating the overlock stitching, and when the overlock stitching device is not used, the lock stitching sewing machine is used as the flat bed sewing machine. When the overlock stitching device is taken out, it may be used as the free arm sewing machine. As is seen from the above, the present invention offers an advancement in the industrial field concerned.

What is claimed as new and desired to be protected by Letters Patent is set forth in the appended claims:

1. A lock stitching and overlock stitching sewing machine having a frame and primary driving means, comprising, in combination, a lock stitching device having a stitch forming part including a needle bar driving mechanism for forming lock stitches, said frame with said primary driving means forming an integral part of said lock stitching device; and an overlock stitching device having a stitch forming part spaced apart from said part for forming lock stitches and including a separate needle bar driving mechanism for forming overlock stitches, said overlock stitching device being disconnectably coupled to said lock stitching device, each stitching device having driving pulleys and a cover to selectively shield said pulleys, and further including means for reversing the movement of said primary driving means in response to the change of position of said cover with respect to said pulleys.

2. A lock stitching and overlock stitching sewing machine having a frame and primary driving means, comprising, in combination, a lock stitching device having a stitch forming part including a needle bar driving mechanism for forming lock stitches, said frame with said primary driving means forming an integral part of said lock stitching device; and an overlock stitching device having a stitch forming part spaced apart from said part for forming lock stitches and including a separate needle bar driving mechanism for forming overlock stitches, said overlock stitching device being disconnectably coupled to said lock stitching device; and wherein said overlock stitching device is coupled to the primary driving means at an increased reduction ratio with respect to that of said lock stitching device.

3. A sewing machine as defined in claim 2, wherein said overlock stitching device has means for feeding cloth in the opposite direction than the cloth feeding direction of said lock stitching device.

4. A sewing machine as defined in claim 2, wherein said overlock stitching device has means for feeding cloth in the same direction as the cloth feeding direction of said lock stitching device.

5. A lock stitching and overlock stitching sewing machine having a frame and primary driving means, comprising, in combination, a lock stitching device having a stitch forming part including a needle bar driving mechanism for forming lock stitches, said frame with said primary driving means forming an integral part of said lock stitching device; and an overlock stitching device having a stitch forming part spaced apart from said part for forming lock stitches and including a separate needle bar driving mechanism for forming overlock stitches, said overlock stitching device being disconnectably coupled to said lock stitches device; and further including a driving shaft for transmitting the movement of the primary driving means rotatable in the normal and reverse directions, and two clutches disposed on said driving shaft for rotation in opposite directions relative to each other.

6. A sewing machine as defined in claim 5, wherein said driving shaft is provided with two clutch rings rotating in one direction, said clutch rings being operable, respectively, for the lock and over-lock stitchings and being axially restrained, and the lock stitching clutch is integrated with a lock stitching pulley and the overlock stitching clutch ring is integrated with an overlock stitching pulley.

7. A sewing machine as defined in claim 6, wherein, in the over-lock stitching device, when the driving shaft is rotated in one direction, the clutch ring and the pulley are engaged with the driving shaft, and when the same is rotated in the other direction, an engagement between the driving shaft and the clutch ring is released.

8. A sewing machine as defined in claim 6, wherein said overlock stitching deviced has means for feeding cloth in the opposite direction than the cloth feeding direction of said lock stitching device.

9. A sewing machine as defined in claim 6, wherein said overlock stitching device has means for feeding cloth in the same direction as the cloth feeding direction of said lock stitching device.

10. A sewing machine as defined in claim 7, wherein in the lock stitching device, only when the driving shaft is rotated in the determined direction, is the clutch ring engaged with the driving shaft.

11. A sewing machine as defined in claim 7, wherein said overlock stitching device has means for feeding cloth in the opposite direction than the cloth feeding direction of said lock stitching device.

12. A sewing machine as defined in claim 7, wherein said overlock stitching device has means for feeding cloth in the same direction as the cloth feeding direction of said lock stitching device.

13. A sewing machine as defined in claim 10, wherein said overlock stitching device has means for feeding cloth in the opposite direction than the cloth feeding direction of said lock stitching device.

14. A sewing machine as defined in claim 10, wherein said overlock stitching device has means for feeding cloth in the same direction as the cloth feeding direction of said lock stitching device.

15. A sewing machine as defined in claim 5, wherein said frame includes a bed, a stand mounted on said bed and a free arm extending from said stand above said bed and defining a flat top portion having a step adapted for accommodating said stitch forming part of said detachable overlock stitching device.

16. A sewing machine as defined in claim 5, wherein said frame includes a bed, a stand on said bed and a free arm extending from said stand above said bed, an edge of said bed having a step adapted for accommodating said stitch forming part of said detachable overlock stitching device.

17. A sewing machine as defined in claim 5, wherein said frame includes a base, a stand mounted on said base, a bed extending from said stand above said base and a free arm extending from said stand above said bed, said stitch forming part of said overlock stitching device being disposed between said bed and said base.

18. A sewing machine as defined in claim 5, wherein said frame includes a bed, a stand on said bed, a free arm extending from said stand above said bed, a bottom portion of said stand having a recess facing the area between said bed and said arm for accommodating between said bed and said stand said stitch forming part of said overlock stitching device.

19. A sewing machine as defined in claim 5, wherein said frame includes a bed, a stand on said bed, a free arm extending on said stand above said bed, an intermediate part of said stand having a recess facing the area between said bed and said free arm for accommodating in said stand said stitch forming part of said overlock stitching device.

20. A sewing machine as defined in claim 5, wherein said frame includes a bed, a stand on said bed, a free arm extending from said stand above said bed, a bottom portion of said stand having a recess at the rear area of the machine for accommodating between said bed and said stand said stitch forming part of the detachable overlock stitching device.

21. A sewing machine as defined in claim 5, wherein said frame includes a bed, a stand on said bed, a free arm extending from said stand above said bed, a bottom portion of said stand having a recess at the rear of the machine for accommodating between said bed and the stand said stitch forming part of said detachable overlock stitching device.

22. A sewing machine as defined in claim 5, wherein said frame includes a bed, a stand above said bed, a free arm extending from said stand above said bed, and a detachable auxiliary bed extending in alignment with the said first mentioned bed for accomodating said stitch forming part of said detachable overlock stitching device.

23. A sewing machine as defined in claim 5, wherein said overlock stitching device includes a step-shaped cover attached to the lock stitching device.

24. A sewing machine as defined in claim 5, wherein said overlock stitching device is driven by the same primary driving means as said lock stitching device.

25. A sewing machine as defined in claim 5, further including manually controlled switching means disposed between said stitching devices to actuate the selected stitching device while bringing the other device to rest.

26. A lock stitching and overlock stitching sewing machine having a frame and a primary driving means, comprising, in combination, a lock stitching device having a stitch forming part including a needle bar driving mechanism for forming lock stitches, said frame with said primary driving means forming an integral part of said lock stitching device; and an overlock stitching device having a stitch forming part spaced apart from said part for forming lock stitches and including a separate needle bar driving mechanism for forming overlock stitches, said overlock stitching device being disconnectably coupled to said lock stitching device; said overlock stitching device including a feeding mechanism having feeding teeth, a hollow shaft with an eccentric cam, said lock stitching device including an upper shaft and a lower shaft, said eccentric cam cooperating with the edges of said upper shaft and said lower shaft for transmitting horizontal and vertical feeding movementts to the feeding teeth.

27. A sewing machine as defined in claim 26, wherein said overlock stitching device has means for feeding cloth in the opposite direction than the cloth feeding direction of said lock stitching device.

28. A sewing machine as defined in claim 26, wherein said overlock stitching device has means for feeding cloth in the same direction as the means for feeding cloth in the same direction as the cloth feeding direction of said lock stitching device.

29. A lock stitching and overlock stitching sewing machine having a frame and primary dirve means, comprising, in combination, a lock stitching device having a stitch forming part including a needle bar driving mechanism for forming lock stitches, said frame with said primary driving means forming an integral part of said lock stitching device; and an overlock stitching device having a stitch forming part spaced apart from said part for forming lock stitches and including a needle bar driving mechanism for forming overlock stitches, said frame including a bed, a stand on said bed, said stand having a recess at the rear area of the machine for accomodating said stitch forming part of the overlock stitching device, said overlock stitching device being disconnectably coupled to said lock stitching device, and further including a driving shaft for transmitting the movement of the primary driving means rotatable in the normal and reverse directions, and two clutches transposed on said driving shaft for rotation in opposite directions relative to each other.

30. A sewing machine as defined in claim 29, further including manually controlled switching means disposed between said stitching devices to actuate the selected stitching device while bringing the other device to rest.

31. A sewing machine as defined in claim 30, wherein said lock stitching device includes a drive shaft and said overlock stitching device includes another drive shaft, said switching means including clutch means arranged between said drive shafts.

* * * * *